US005661116A

United States Patent [19]

Périard

[11] Patent Number: 5,661,116

[45] Date of Patent: Aug. 26, 1997

[54] LUBRICANT COMPOSITION FOR PREVENTING CARBORIZATION IN THE PRODUCTION OF SEAMLESS PIPES

[75] Inventor: Jacques Périard, Sins, Switzerland

[73] Assignee: Timcal Ltd., Bodio, Switzerland

[21] Appl. No.: 657,029

[22] Filed: May 29, 1996

[30] Foreign Application Priority Data

May 30, 1995 [CH] Switzerland ..... 1581/95

[51] Int. Cl.[6] ..... C10M 125/02; C10M 125/26; C10M 173/02

[52] U.S. Cl. ..... 508/126; 72/42

[58] Field of Search ..... 508/126; 72/42

[56] References Cited

U.S. PATENT DOCUMENTS

| | | | |
|---|---|---|---|
| 1,519,268 | 12/1924 | Schnell | 508/126 |
| 2,711,394 | 6/1955 | Veatch | 508/126 |
| 3,041,277 | 6/1962 | Pfefferkorn | 508/126 |
| 3,198,735 | 8/1965 | Lamson et al. . | |
| 3,244,625 | 4/1966 | Silwones . | |
| 3,485,753 | 12/1969 | Allais | 508/126 |
| 3,912,639 | 10/1975 | Adams . | |
| 4,039,337 | 8/1977 | Brown et al. . | |
| 4,052,323 | 10/1977 | Feneberger et al. . | |
| 4,088,585 | 5/1978 | Karpen . | |
| 4,104,178 | 8/1978 | Jain et al. . | |
| 4,402,838 | 9/1983 | Eguchi et al. . | |
| 4,710,307 | 12/1987 | Periard et al. . | |
| 5,143,631 | 9/1992 | Furrer . | |
| 5,492,639 | 2/1996 | Schneider et al. | 508/126 |

OTHER PUBLICATIONS

Patent Abstracts of Japan, vol. 018, No. 331, M-1626, Jun. 23, 1994.

*Primary Examiner*—Margaret Medley
*Attorney, Agent, or Firm*—Fisher, Christen & Sabol

[57] ABSTRACT

A lubricant composition comprising graphite, a clay mineral, and a silica sol or a potassium aluminum silicate. The lubricant composition is suitable for preventing carburization in the production of seamless pipes.

21 Claims, No Drawings

LUBRICANT COMPOSITION FOR PREVENTING CARBORIZATION IN THE PRODUCTION OF SEAMLESS PIPES

BACKGROUND OF THE INVENTION

1. Field of the Invention

The invention relates to a novel lubricant composition which is suitable for preventing carburization on the inner surface of the tube blanks in the production of seamless pipes, and to processes of preventing such carburization.

2. Background Art

In modern tube rolling mills, e.g., in continuous trains (MPM-trains), the seamless pipes are formed in the main process step by rolling a prefabricated tube blank at 1200° to 1300° C. over a mandrel which is mounted on a mandrel bar. Under the influence of atmospheric oxygen or lubricants, numerous chemical reactions occur on the hot tube blank surface. Thus, the known scale (Fe oxides) forms with atmospheric oxygen, for example, which scale, if it is not removed, leads to damage of the pipe wall. It has been found that in rolling processes where scale formation is effectively suppressed and where the tube blanks do not come into contact with atmospheric oxygen, the phenomenon of carburization occurs. In a reaction interrelationship which has not been ultimately explained, a layer of iron carbides forms on the hot steel surface of the tube blanks in this process, which iron carbides, because of their hardness, lead in the rolling operation to damage (scratches) on the pipe inner wall.

BROAD DESCRIPTION OF THE INVENTION

The main object of the invention is to provide a suitable lubricant which effectively prevents carburization. Other objects and advantages of the invention are set out herein or are obvious herefrom to one skilled in the art.

The objects and advantages of the invention are achieved by the lubricant compositions and the processes of the invention.

The lubricant composition of the invention comprises:

a) 50 percent by weight to 85 percent by weight of graphite;

b) 2 percent by weight to 12 percent by weight of one or more (i.e., at least one) clay minerals from the smectite class;

c1) 5 percent by weight to 45 percent by weight of a silica sol, or c2) 25 percent by weight to 45 percent by weight of a potassium aluminum silicate.

Suitable graphites are very finely divided synthetic graphites having a mean particle size $d_{50}$ of 1 μm to 10 μm. The particle upper limit is expediently 8 μm to 50 μm. Preferably, the graphites employed are distinguished by a high purity of ≧99 percent and a crystallinity Lc≧60 nm. Particularly preferably are the finely divided KS types (of graphite) from Timcal, Ltd., Bodio, Switzerland, are employed; for example, in particular KS 6, KS 10 or KS 15 (graphites) are especially preferred.

The clay minerals from the smectite classes essentially comprise sheet silicates and as a result of their structure are distinguished by a high cation exchange capacity and by a high swellability in water. (Ullmanns Encyklopädie der techn. Chemie [Ullmann's Encyclopedia of Industrial Chemistry], Edition 4, VCH, Weinheim, Vol. 23, pp. 311 ff.). Of the smectite group, montmorillonites are preferably used, in particular those which have a swelling capacity (1 g of montmorillonite with distilled water) of 10 to 50. The primary particle size (with complete dispersion) is also essential, so that a smectite having a mean particle size $d_{50}$ of 1 μm to 10 μm is expediently used.

A silica sol is taken to mean a colloidal solution of $SiO_2$-particles having a mean particle size $d_{50}$ of 6 nm to 30 nm in water. The solid content of the such sol is expediently between 30 percent by weight and 40 percent by weight. Preferably, the silica sol has an $Na_2O$ content of 0.15 percent to 0.4 percent and a specific BET surface area of approximately 200 $m^2/g$ to 300 $m^2/g$.

The term potassium aluminum silicate includes a sheet or leaf silicate occurring under the mineral name mica. A mica of the muscovite type is expediently employed. The finely divided character is also essential here, so that a mica having a mean particle size $d_{50}$ of 5 μm to 10 μm is expediently used.

The lubricant composition of the invention can be prepared in an application- and customer-based manner in two fundamental formulations, either as a ready-to-use dispersion or as a powder which the customer himself disperses.

A lubricant composition which is suitable for a ready-to-use dispersion expediently comprises:

50 percent by weight to 85 percent by weight of graphite;

2 percent by weight to 5 percent by weight of one or more clay minerals from the smectite class;

5 percent by weight to 45 percent by weight of a silica sol.

This lubricant composition is advantageously processed with water in conventional dispersion apparatuses which make high shearing forces possible, to give an aqueous dispersion having a solids content of 20 percent to 35 percent. Ideally, the viscosity of this dispersion (Rheomat 15, System B, 20° C., speed 5) within the range 1000 MPas to 4000 MPas.

A lubricant composition which is suitable for a powder which the customer himself disperses expediently comprises:

50 percent by weight to 75 percent by weight of graphite;

2 percent by weight to 12 percent by weight of one or more clay minerals from the smectite class;

20 percent by weight to 45 percent by weight of a potassium aluminum silicate.

This lubricant composition is employed in the form of an aqueous dispersion having a solids content of expediently 25 percent by weight to 35 percent by weight. The dispersion can be prepared using conventional dispersion apparatuses which make high shearing forces possible. Ideally, the viscosity of this dispersion (Rheomat 15, System B, 20° C., speed 5) is between 1500 MPas and 4000 MPas.

A commercial foam-suppressing compound, e.g., a polyalkylene glycol, can be added to the lubricant composition up to an amount of approximately 1 percent.

The lubricant compositions of the invention are applied to the roller mandrel in the context of the rolling operation by a suitable spraying apparatus for disperse systems, the water evaporating and a lubricating film forming which spreads onto the inner side of the tube blank in the rolling operation and, thus, effectively suppresses carburization.

EXAMPLES

Viscosity measurements were made in a Rheomat 15, System B at 20° C. and speed 5.

Formulation I (Dispersion)

| | |
|---|---|
| 82.11% by weight | Graphite (Graphite KS 6, Timcal Ltd., Bodio, Switzerland; particle size $d_{50}$ 3.3 μm, purity 99.9%, Lc ≧60 nm) |
| 12.46% by weight | Silica sol (Levasil 300/30%, Bayer AG; particle size $d_{50}$ 7–8 nm, $Na_2O$ content 0.35%, specific surface area 300 $m^2/g$) |
| 4.94% by weight | Smectite (Bentone EW, Kronos Titan GmbH; montmorillonite, particle size $d_{50}$ 2.5 μm) |
| 0.49% by weight | Foam suppresser (Dehydran 1922, Henkel) |
| Solids content of the dispersion: | 30% |
| Viscosity: | 1800 MPas |
| Coefficient of friction: | at 100° C. (mandrel) and 1050° C. (tube blank) = 0.079 |

Formulation 2 (Dispersion)

| | |
|---|---|
| 54.03% by weight | Graphite (Graphite KS 6, Timcal, Ltd., Bodio, Switzerland) |
| 42.38% by weight | Silica sol (Levasil 300/30%, Bayer AG) |
| 3.25% by weight | Smectite (Bentone EW, Kronos Titan GmbH) |
| 0.34% by weight | Foam suppresser (Dehydran 1922, Henkel) |
| Solids content of the dispersion: | 28.3% |
| Viscosity: | 2800 MPas |
| Coefficient of friction: | at 100° C./1050° C. = 0.091 |

Formulation 3 (Dispersion)

| | |
|---|---|
| 60.00% by weight | Graphite (Graphite KS 6, Timcal, Ltd., Bodio, Switzerland) |
| 36.00% by weight | Silica sol (Levasil 300/30%, Bayer AG) |
| 3.65% by weight | Smectite (Bentone EW, Kronos Titan GmbH) |
| 0.35% by weight | Foam suppresser (Dehydran 1922, Henkel) |
| Solids content of the dispersion: | 31.2% |
| Viscosity: | 3400 MPas |
| Coefficient of friction: | at 100° C./1050° C. = 0.093 |

Formulation 4 (powder)

| | |
|---|---|
| 51.90% by weight | Graphite (Graphite KS 6, Timcal, Ltd., Bodio, Switzerland) |
| 39.70% by weight | Potassium aluminum silicate (Mica G, Aspanger; particle size $d_{50}$ 7 μm) |
| 8.00% by weight | Smectite (Bentonite MB 300S, Fordamin, particle size $d_{50}$, 6.5 μm) |
| 0.40% by weight | Foam suppresser (Dehydran 1922, Henkel) |
| The powder was then dispersed in water. | |
| Solids content of the dispersion: | 30% |
| Viscosity: | 3900 MPas |
| Coefficient of friction: | at 100° C./1050° C. = 0.089 |

Formulation 5 (Powder)

| | |
|---|---|
| 67.60% by weight | Graphite (Graphite KS 6, Timcal, Ltd., Bodio, Switzerland) |
| 20.00% by weight | Potassium aluminum silicate (Mica G, Aspanger) |
| 12.00% by weight | Smectite (Bentonite MB 300S, Fordamin) |
| 0.40% by weight | Foam suppresser (Dehydran 1922, Henkel) |
| Solids content of the dispersion: | 25% |
| Viscosity: | 1500 MPas |
| Coefficient of friction: | at 100° C./1050° C. = 0.085 |

Comparison formulation (according to German Patent No. 2,450,716)

| | |
|---|---|
| 20% by weight | Graphite |
| 9.5% by weight | Vinyl acetate mixed polymer |
| 1% by weight | Polysaccharide |
| 69.5% by weight | Water |
| Solids content of the dispersion: | 30% |
| Viscosity | 1500 to 3000 MPas |
| Coefficient of friction: | at 100° C./1050° C. = 0.09 |

Test

The formulations 1 to 5, and the comparison formulation, were applied individually into a groove made on the surface of a metallic solid, the groove having the dimensions 20 mm×2 mm×2 mm. The treated solid was then dried in an argon atmosphere for 3 hours at 80° C., then heated in the course of 90° seconds to 1250° C., kept at this temperature for 30 seconds and then allowed to cool. A disc-shaped specimen having a thickness of approximately 5 mm was sawed from this solid, encapsulated with an epoxy resin and developed with nital 2% (methanolic nitric acid).

The sample was then studied by microscopy.

Results:

| Formulation | Carburization mm |
|---|---|
| 1 | 0 |
| 2 | 0 |
| 3 | 0 |
| 4 | 0 |
| 5 | 0 |
| Comparison | 0.5–0.8 |

What is claimed is:

1. A process for preventing carburization in the production of seamless pipes, comprising treating a roller mandrel prior to a rolling operation with a lubricant composition which is in the form of an aqueous dispersion and comprises:

(a) 50 percent by weight to 85 percent by weight of graphite;

(b) 2 percent by weight to 12 percent by weight of one or more clay minerals from the smectite class, the clay having a mean particle size $d_{50}$ of 1 μm to 10 μm;

(c) 5 percent by weight to 45 percent by weight of a silica sol, the $SiO_2$ particles in the silica sol having a mean diameter of 6 nm to 30 nm, or (d) 25 percent by weight to 45 percent by weight of a potassium aluminum silicate, the potassium aluminum silicate having a mean particle size of 5 μm to 10 μm.

2. The process as claimed in claim 1 wherein the lubricant composition comprises:

50 percent by weight to 85 percent by weight of graphite, 2 percent by weight to 5 percent by weight of one or more clay minerals from the smectite class, and 5 percent by weight to 45 percent by weight of silica sol, and the aqueous dispersion has a solids content of 20 percent by weight to 35 percent by weight.

3. The process as claimed in claim 1 wherein the lubricant composition comprises:

50 percent by weight to 75 percent by weight of graphite, 2 percent by weight to 12 percent by weight of one or more clay minerals from the smectite class, and 20 percent by weight to 45 percent by weight of a potassium aluminum silicate, and the aqueous dispersion has a solids content of 25 percent by weight to 35 percent by weight.

4. The process as claimed in claim 2 wherein the graphite is a synthetic graphite having a mean particle size of 1 μm to 10 μm.

5. The process as claimed in claim 4 wherein the clay mineral from the smectite class is a montmorillonite.

6. The process as claimed in claim 5 wherein the silica sol is an aqueous sol of a colloidal silicic acid.

7. The process as claimed in claim 3 wherein the graphite is a synthetic graphite having a mean particle size of 1 μm to 10 μm.

8. The process as claimed in claim 7 wherein the clay mineral from the smectite class is a montmorillonite.

9. The process as claimed in claim 8 wherein the potassium aluminum silicate is a mineral from the mica class.

10. The process as claimed in claim 1 wherein the graphite is a synthetic graphite having a mean particle size of 1 μm to 10 μm.

11. The process as claimed in claim 10 wherein the clay mineral from the smectite class is a montmorillonite.

12. The process as claimed in claim 11 wherein the silica sol is an aqueous sol of a colloidal silicic acid.

13. The process as claimed in claim 12 wherein the potassium aluminum silicate is a mineral from the mica class.

14. The process as claimed in claim 12 wherein the lubricant composition comprises:

50 percent by weight to 85 percent by weight of graphite, 2 percent by weight to 5 percent by weight of one or more clay minerals from the smectite class, and 5 percent by weight to 45 percent by weight of the aqueous sol of the colloidal silicic acid.

15. The process as claimed in claim 14 wherein the lubricant composition is in the form of an aqueous dispersion having a solids content of 20 percent by weight to 35 percent by weight.

16. The process as claimed in claim 13 wherein the lubricant composition comprises:

50 percent by weight to 75 percent by weight of graphite, 2 percent by weight to 12 percent by weight of one or more clay minerals from the smectite class, and 25 percent by weight to 45 percent by weight of the mica class mineral.

17. The process as claimed in claim 16 wherein the lubricant composition is in the form of an aqueous dispersion having a solids content of 25 percent by weight to 35 percent by weight.

18. The process as claimed in claim 1 wherein the clay mineral from the smectite class is a montmorillonite.

19. The process as claimed in claim 1 wherein the silica sol is an aqueous sol of a colloidal silicic acid.

20. The process as claimed in claim 1 wherein the potassium aluminum silicate is a mineral from the mica class.

21. The process as claimed in claim 1 wherein the lubricant composition comprises:

50 percent by weight to 85 percent by weight of graphite, 2 percent by weight to 12 percent by weight of one or more clay minerals from the smectite class, and 25 percent by weight to 45 percent by weight of a potassium aluminum silicate.

* * * * *